US006605897B1

(12) United States Patent
Yoo

(10) Patent No.: US 6,605,897 B1
(45) Date of Patent: Aug. 12, 2003

(54) PLASMA DISPLAY PANEL AND ITS DRIVING METHOD

(75) Inventor: Jun Yeong Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/431,926

(22) Filed: Nov. 2, 1999

(30) Foreign Application Priority Data

Nov. 3, 1998 (KR) ..... P1998-46984
Nov. 14, 1998 (KR) ..... P1998-48954
Nov. 14, 1998 (KR) ..... P1998-48959

(51) Int. Cl.[7] ..... H01J 17/49

(52) U.S. Cl. ..... 313/582; 313/586; 313/484; 315/169.3

(58) Field of Search ..... 313/582, 583, 313/584, 585, 586, 587, 483–485; 315/169.4, 169.3

(56) References Cited

U.S. PATENT DOCUMENTS 5,446,344 A * 8/1995 Kanazawa ..... 315/169.4
6,271,810 B1 * 8/2001 Yoo et al. ..... 315/169.4 X
6,340,866 B1 * 1/2002 Yoo ..... 315/169.3

FOREIGN PATENT DOCUMENTS

JP 06-310040 4/1994
JP 10-171399 6/1998

* cited by examiner

*Primary Examiner*—Vip Patel
*Assistant Examiner*—Joseph Williams
(74) *Attorney, Agent, or Firm*—Fleshner & Kim, LLP

(57) ABSTRACT

A plasma display panel and a method of driving the same that are capable of improving the discharge efficiency using a direct current type discharge and a radio frequency discharge. In the panel, an address discharge for selecting a display cell is generated by a direct current discharge. A data written into the selected cell is displayed by a radio frequency discharge. The address discharge of direct current type and the radio frequency discharge are allowed to maximize the brightness and the discharge efficiency.

14 Claims, 14 Drawing Sheets

PLASMA DISPLAY PANEL AND ITS DRIVING METHOD

BACKGROUND OF THE INVENTION

1. Field of the Invention

This invention relates to a plasma display device, and more particularly to a plasma display panel that is capable of improving the discharge efficiency using a direct current discharge and a radio frequency discharge. Also, the present invention is directed to a method of driving the same.

2. Description of the Related Art

Recently, a plasma display panel(PDP) feasible to the fabrication of large-scale panel has been available for a flat panel display device. The PDP controls a discharge interval of each pixel to display a picture. Such a PDP is classified into a direct current(DC) type and an alternating current (AC) type in accordance with its electrode structure. An electrode is directly exposed to a discharge gas in the case of a DC-type PDP while an electrode is indirectly exposed through a dielectric material in the case of an AC-type PDP.

Referring to FIG. 1, there is shown a discharge cell structure arranged in a matrix pattern in an AC-type PDP with three electrodes. The PDP discharge cell includes an upper plate having a sustaining electrode pair 12A and 12B formed on an upper substrate 10 sequentially, an upper dielectric layer 14 and a protective film 16, and a lower plate having an address electrode 20 formed on a lower substrate 18 sequentially, a lower dielectric layer 22, a barrier rib 24 and a fluorescent layer 26. The upper substrate 10 is spaced from the lower substrate 18 by the barrier rib 24. The sustaining electrode pair 12 consists of a scanning/sustaining electrode and a sustaining electrode. A scanning signal for a panel scanning and a sustaining signal for a discharge sustaining are applied to the scanning/sustaining electrode while a sustaining signal is applied to the sustaining electrode. A charge is accumulated in the upper dielectric layer 14 and the lower dielectric layer 22. The protective film 16 prevents a damage of the upper dielectric layer 14 caused by the sputtering to prolong a life of the PDP as well as to improve an emission efficiency of secondary electrons. Usually, MgO is used as the protective film 16. The address electrode 20 is crossed with the sustaining electrode pair 12. Data signals for selecting cells to be displayed are applied to the address electrode 20. The barrier rib 24 is formed in parallel to the address electrode 20. The barrier rib 24 prevents an ultraviolet ray produced by the discharge from being leaked into the adjacent discharge cells. The fluorescent layer 26 is coated on the surface of the lower dielectric layer 22 and the barrier rib 24 to generate any one of red, green and blue visible lights. An inactive gas for a gas discharge is sealed into the inner discharge space.

After the PDP discharge cell with such a structure was selected between the address electrode 20 and the scanning/sustaining electrode, it sustains the discharge by a surface discharge between the sustaining electrode pair 12. The fluorescent body 26 is luminous by an ultraviolet generated during the sustaining discharge at the PDP discharge cell and hence a visible light is emitted into the exterior of the discharge cell. As a result, the PDP including the discharge cells displays a picture. In this case, the PDP controls a discharge-sustaining interval, that is, a sustaining discharge frequency of the cell to implement a gray scale required for an image display. In this respect, the sustaining discharge frequency becomes an important factor determining the brightness and a discharge efficiency of the PDP. For the sake of such a sustaining discharge, a sustaining pulse having a duty ratio of 1, a frequency of 200 to 300 kHz and a width of about 20 $\mu$s are alternately applied to the sustaining electrode pair 12A and 12B. In response to the sustaining pulse, the sustaining discharge generates only one time at an extremely short instant per sustaining pulse. Charge particles generated by the sustaining discharge move a discharge path formed between the sustaining electrode pair 12A and 12B depending on the polarity of the sustaining electrode pair 12A and 12B to thereby form a wall charge on the surface of the upper dielectric layer 14. This wall charge cancels a voltage applied between the sustaining electrode pair 12A and 12B to reduce a discharge voltage loaded in the discharge space, thereby stopping the sustaining discharge. As described above, the sustaining discharge is generated only once at an extremely shorter instant than a width of the sustaining pulse. Most of the remaining time is wasted for a preparation step for the formation of wall charge and the next sustaining discharge. For this reason, since the conventional PDP has a very short real discharge interval compared with the entire discharge interval, it has low brightness and low discharge efficiency. Referring now to FIG. 2, there is shown the structure of a discharge cell arranged in a matrix pattern in a DC-type PDP. The DC-type discharge cell includes a cathode 30 formed on an upper substrate 10, an anode 32 and an auxiliary anode 34 each formed on a lower substrate 18, and a barrier rib 24 formed between the upper substrate 10 and the lower substrate 18 to provide a main discharge space 31 and an auxiliary discharge space 33. The DC-type discharge cell consists of a main discharge cell provided with the main discharge space 31 and an auxiliary discharge cell provided with the auxiliary discharge space 33. Charged particles produced at the auxiliary discharge cell are introduced into the main discharge cell to cause a display discharge at the main discharge cell. The barrier rib 24 is formed in a lattice structure to prevent a mis-discharge between the adjacent cells caused by a diffusive movement of the charge particles generated by the auxiliary discharge. The anode 32 is formed on the lower substrate 18 provided with the main discharge space 31 while the auxiliary anode 34 is formed on the lower substrate 18 provided with the auxiliary discharge space 33. A current limiting resistor 36 is provided between the anode 32 and the lower substrate 18 to limit an overshoot of the discharge current. The DC-type discharge cell having the structure as described above generates the discharge between the cathode 30 and the anode 32 and makes use of an auxiliary discharge in the auxiliary discharge cell so as to lower a discharge voltage in the main discharge cell. In other words, by the auxiliary discharge generated from the cathode 30 and the auxiliary anode 34 in the auxiliary discharge cell, charged particles are produced. Then, the charged particles are moved into the main discharge space 31 through a hole defined between the main discharge space 31 and the auxiliary discharge space 33 and used for a display discharge caused by the cathode 30 and the anode 32.

The DC-type PDP has an advantage in that it has more excellent contrast than the AC-type PDP because a light generated by the auxiliary discharge is shut off by means of a black matrix(not shown) formed on the upper plate. Also, in view of a fact that the AC-type PDP has a time interval at which the discharge is stopped even when a discharge voltage pulse is being applied by a wall charge formed in the dielectric layer while the DC-type PDP generates a continuous discharge when a discharge voltage pulse is being applied, it can be said that the DC-type PDP has a relatively good discharge efficiency. However, the DC-type PDP has a disadvantage in that total discharge efficiency is low due to an energy loss caused by the auxiliary discharge and the resistance.

Further, the AC-type and DC-type PDP rely on only a negative glow discharge having a poor discharge efficiency because the size of the discharge cell is too small, that is, because a distance between the electrodes is very short. In addition, the conventional AC-type and DC-type PDP has a problem in that most of an electric energy applied to the discharge space 21 is wasted to cause a low brightness because a negative glow is used at the time of their luminescence.

Referring to FIG. 3, there is shown the structure of a typical glow discharge tube. It can be seen from FIG. 3 that a negative glow 42A generates in the neighborhood of the cathode 38 while a positive column 42B appears in a shape of tube at the anode 40 when a distance between two electrodes 38 and 40 is sufficiently long. A space between the negative glow 42A and the positive column 42B is called the Faraday dark space. In this case, the positive column 42B is disappeared when a distance between two electrodes 38 and 40 is shortened and the negative glow 42A is reduced when it is more and more shortened. Accordingly, the brightness and the discharge efficiency are lowered. A problem resulting from such low brightness and discharge efficiency becomes serious as a higher resolution is needed, thereby causing more deteriorated brightness and discharge efficiency. Accordingly, there has been attempted a scheme of utilizing a positive column for providing a good discharge efficiency by changing the discharge area or lengthening the discharge path so as to increase the brightness and discharge efficiency within the limited space of the discharge cell. However, to lengthen a distance between the electrodes for the purpose of lengthening the discharge path raises the discharge voltage to cause many difficulties such as a development of a high voltage driving integrated circuit(IC), etc. As a result, it is necessary to provide a novel discharge and driving mechanism that is capable of lengthening the discharge path with the aid of other discharge mechanism in the existent discharge cell structure.

In order to solve such a low brightness and discharge efficiency problem in the PDP, we had filed a patent application regarding to a method of utilizing a radio frequency discharge using a radio frequency of hundreds of MHz as a display discharge. In the case of the radio frequency discharge, electrons do a vibrating motion by a radio frequency signal, so that a display discharge is sustained in a time interval when a radio frequency signal is applied. More specifically, if a radio frequency voltage signal having the polarity alternating continuously is applied to any one of two opposed electrodes, then electrons within the discharge space is moved into one electrode or the other electrode in accordance with the polarity of the voltage signal. When electrons are moved toward any one electrode, if the polarity of the applied radio frequency voltage signal is changed before the electrons arrive at the electrode, then a movement speed of the electrons is gradually decreased and ultimately a movement direction of the electrons is changed, so that the electrons are moved toward the opposite electrode. If the polarity of a radio frequency voltage signal applied to an electrode is changed before electrons within the discharge space arrive at the electrode, then the electrons do an oscillating motion between the two electrodes. Accordingly, when the radio frequency voltage signal is being applied, the ionization, excitation and transition of gas particles are generated continuously without an extinction of electrons. As described above, the display discharge is sustained during most of discharge time, so that the brightness and discharge efficiency of the PDP can be improved. Such a radio frequency discharge has a physical characteristic identical to a positive column in the glow discharge structure. However if both the address discharge and the sustaining discharge are generated by the radio frequency discharge, then a driving of the PDP becomes not only complicated during the addressing, but also a high voltage is required to cause a rise of the power consumption.

SUMMARY OF THE INVENTION

Accordingly, it is an object of the present invention to provide a PDP that is capable of improving a discharge efficiency thereof using a radio frequency as well as carrying out a stable addressing.

Further object of the present invention is to provide a PDP driving method that is adaptive for driving said PDP using a radio frequency.

In order to achieve these and other objects of the invention, according to one aspect of the present invention, an address discharge for selecting a display cell is generated by a direct current discharge, and a data written into the selected cell is displayed by a radio frequency discharge. To this end, a PDP according to the present invention a direct current discharging electrode part for applying a direct current to cause a writing discharge within the discharge cells, said electrode part having electrodes crossed with each other; and a radio frequency discharging electrode part for applying a radio frequency voltage to generate a sustaining discharge caused by a radio frequency discharge within the discharge cells.

According to another aspect of the present invention, each of discharge cells in the PDP includes first and second substrates opposed to each other; a cathode formed on the first substrate; a barrier rib formed between the first and second substrates to provide an auxiliary discharge space and a main discharge space; an anode formed on the second substrate provided with the main discharge space; an auxiliary anode formed on the second substrate provided with the auxiliary discharge space; and first and second radio frequency electrodes formed in opposition to the barrier rib providing the main discharge space.

According to still another aspect of the present invention, a method of driving a plasma display panel includes a writing discharge step of responding to an opposite polarity of direct current voltage applied to each of the address electrode and the scanning electrode formed to be opposed to each other to cause a direct current discharge, thereby selecting a display cell; and a sustaining discharge step of sustaining a discharge within the selected display cell with a radio frequency discharge caused by a radio frequency voltage applied to each of first and second radio frequency electrodes.

According to still another aspect of the present invention, a method of driving a plasma display panel includes the steps of initiating a radio frequency discharge at the entire panel; sustaining the radio frequency discharge and generating an erasure discharge selectively in accordance with a gray level of a display cell to stop the radio frequency discharge; and stopping the radio frequency discharge in all the display cells when a sustaining discharge interval is terminated.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
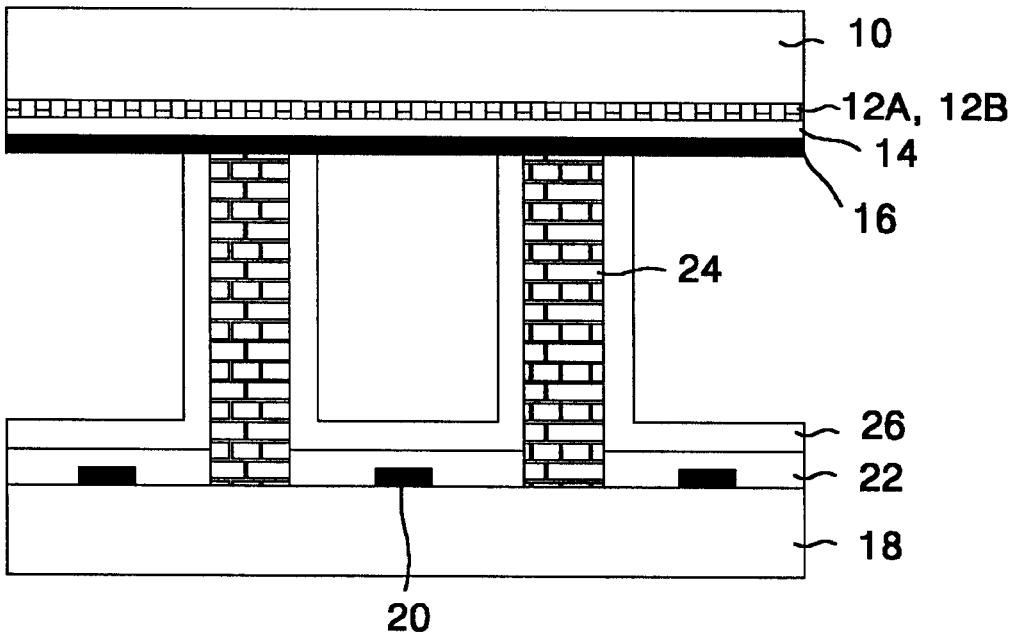
FIG. 1 RELATED ART
FIG. 1 is a sectional view showing the structure of a discharge cell in the conventional AC-system PDP.
Figure 2:
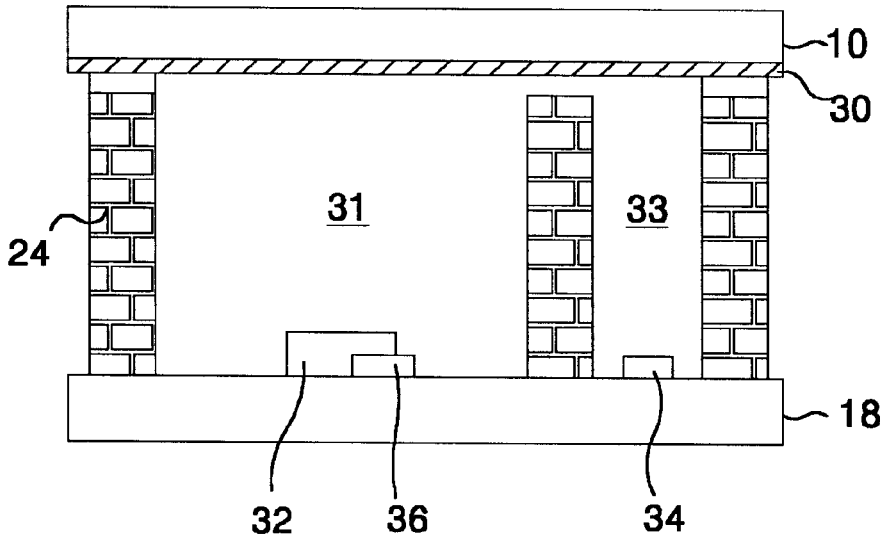
FIG. 2 RELATED ART
FIG. 2 is a sectional view showing the structure of a discharge cell in the conventional DC-system PDP.
Figure 3:
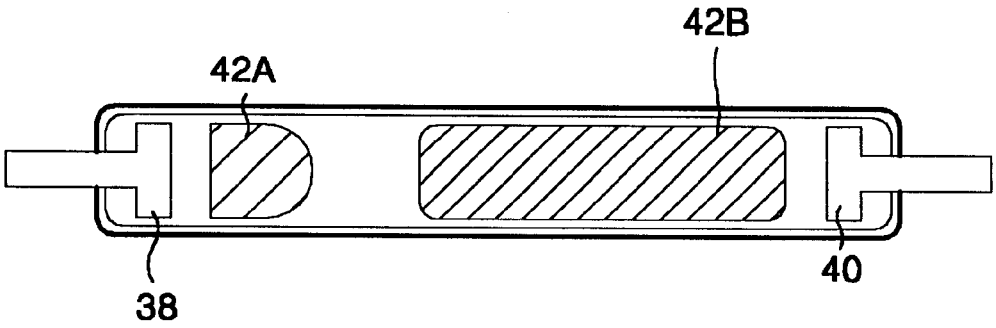
FIG. 3 RELATED ART
FIG. 3 is a schematic sectional view showing the structure of the conventional glow discharge tube.
Figure 4:
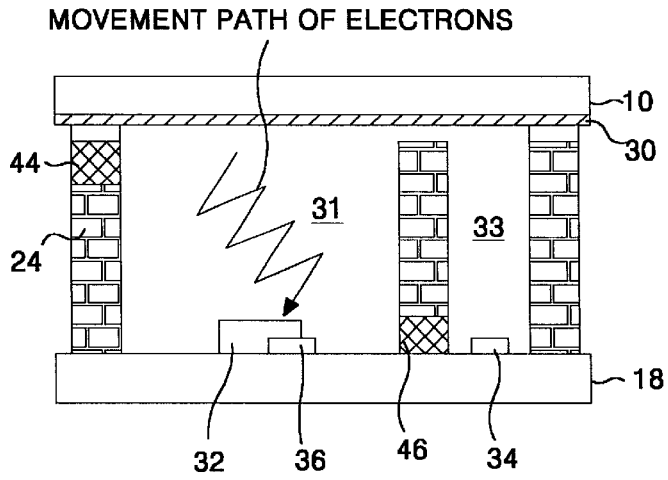
FIG. 4 is a sectional view showing the structure of a discharge cell in a PDP according to an embodiment of the present invention.
Figure 5:
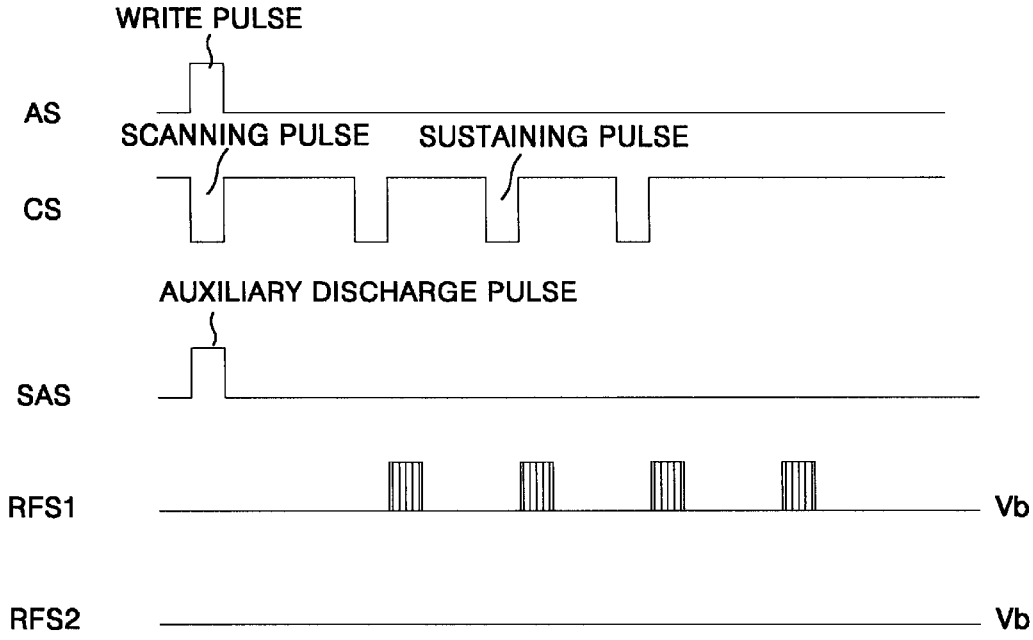
FIG. 5 is waveform diagrams of a voltage for driving the discharge cell in FIG. 4.

Referring to FIG. 4, there is shown a discharge cell in a DC-type PDP according to an embodiment of the present invention. The discharge cell includes a cathode 30 formed on an upper substrate 10, an anode 32 and an auxiliary anode 34 each formed on a lower substrate 18, a barrier rib 24 provided between the upper substrate 10 and the lower substrate 18, and first and second radio frequency electrodes 44 and 46 opposed to the barrier rib 24 provided with a main discharge space 31. The upper substrate 10 as a display screen of a picture is arranged in opposition to the lower substrate 18. The barrier rib 24 is formed between the upper substrate 10 and the lower substrate 18 to provide the main discharge space 31 and an auxiliary discharge space 33. In addition, the barrier rib 24 is formed in a lattice structure to prevent a mis-discharge between the adjacent cells caused by a diffusive movement of the charge particles generated by the auxiliary discharge. The anode 32 is formed on the lower substrate 18 provided with the main discharge space 31 while the auxiliary anode 34 is formed on the lower substrate 18 provided with the auxiliary discharge space 33. The anode 32 and the auxiliary anode 34 are connected to each bus line(not shown) arranged in a direction crossing with the cathode 30 formed on the upper substrate 10. A current limiting resistor 36 is provided between the anode 32 and the lower substrate 18 to limit an overshoot of the discharge current as well as to restrain a sputtering into the cathode. Each of the first and second radio frequency electrodes 44 and 46 are formed in opposition to the barrier rib 24 provided with the main discharge space 31. For instance, the first and second radio frequency electrodes 44 and 46 are formed in the diagonal direction in opposition to each other. A fluorescent material(not shown) is coated on the surface of the barrier rib 24 and the peripheral of the anode 32 in the main discharge space 31. A method of driving the DC-type discharge cell with the above-mentioned structure will be described in detail with reference to driving waveform diagrams in FIG. 5.

First, a scanning pulse is applied to the cathode 30 and an auxiliary discharging pulse is applied to the auxiliary anode 34, to thereby generate an auxiliary discharge at the auxiliary discharge space 33. Charged particles produced by the auxiliary discharge are diffused, via a hole at the barrier rib 24, into the main discharge space 31. At the same time, a write pulse is applied to the anode 32 to generate the discharge at the main discharge space 31. Such a discharge is sustained by a sustaining pulse applied to the cathode 30. By this sustaining discharge, electrons excite gas atoms and molecules sealed in the main sustaining space 31 while moving from the cathode 30 into the anode 32 to emit a vacuum ultraviolet ray. During the sustaining discharge, a radio frequency voltage is applied between the first and second radio frequency electrodes 44 and 46 to change an electric field of the main discharge space 31. More specifically, a radio frequency voltage is applied to the first radio frequency electrode 44 and a center voltage Vb of the radio frequency voltage is applied to the second radio frequency electrode 46, to thereby generate an oscillating electric field at the main discharge space 31. By this oscillating electric field, a motion direction of electrons being moved from the cathode 30 into the anode 32 is disturbed. In other words, the electrons are moved in a zigzag direction at the main discharge space 31 by the oscillating electric field. Accordingly, the electrons excite greater amount of gas atoms and molecules sealed in the main discharge space 31 while moving along a considerably long path. As a result, much more vacuum ultraviolet rays are generated to radiate a fluorescent body, so that the brightness and the discharge efficiency can be improved.

In this case, a radio frequency voltage applied to the first radio frequency electrode 44 is applied in such a manner to have a desired time difference from a sustaining pulse applied to the cathode 30 so as not to make an affect to an initiation of the sustaining discharge. Further, in order to prevent charged particles caused by the sustaining discharge (or the direct current discharge) from being leaked into the barrier rib 24, the voltage and frequency values of a radio frequency voltage signal applied to the first radio frequency electrode 44 are selected in such a manner that an oscillation width of electrons being moved from the cathode 30 into the anode 32 by the sustaining discharge is much smaller than that of the main discharge space 31. Herein, the radio frequency voltage pulse may have various waveform shapes such as rectangular wave and sinusoidal wave, etc.

As described above, the DC-type PDP according to the present invention applies a radio frequency voltage to a motion path of charged particles caused by the direct current discharge to lengthen a discharge path of the charged particles, so that it can improve the brightness and the discharge efficiency.

Figure 6:
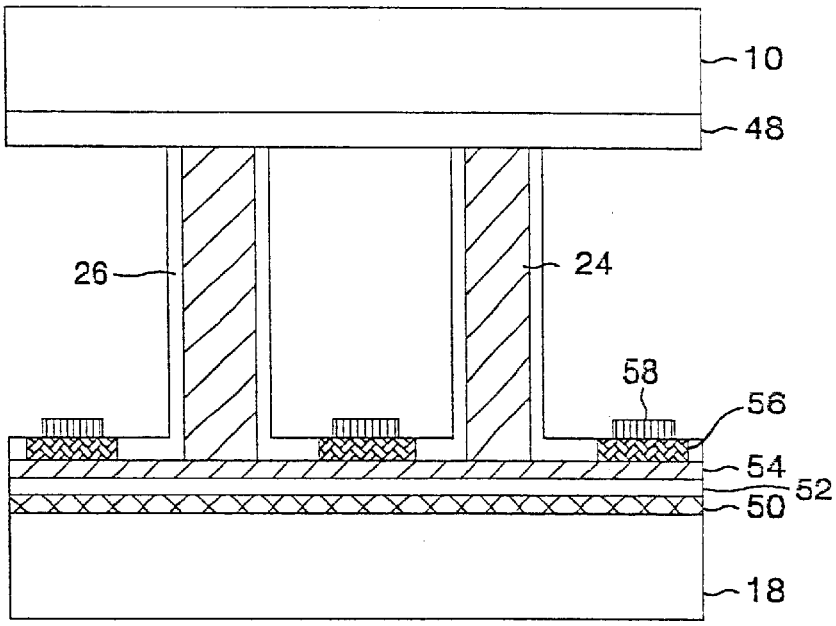
FIG. 6 is a sectional view showing the structure of a discharge cell in a PDP according to another embodiment of the present invention.
Figure 7:
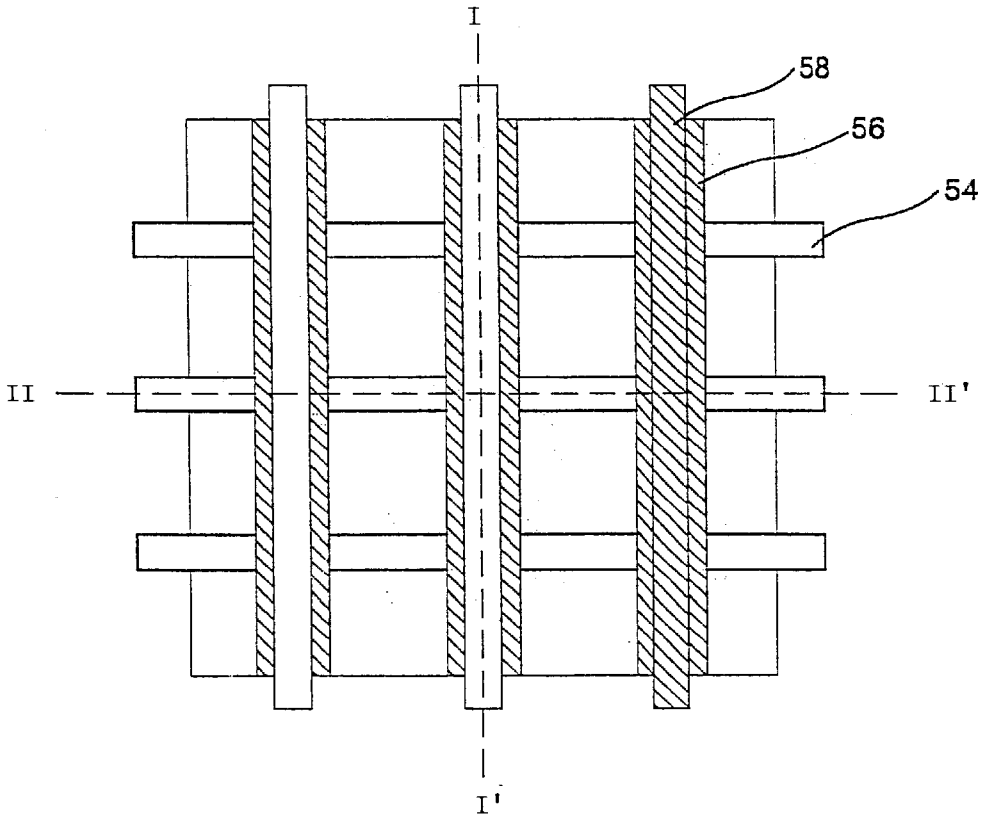
FIG. 7 is a plan view of the lower plate shown in FIG. 6.
Figure 8A:
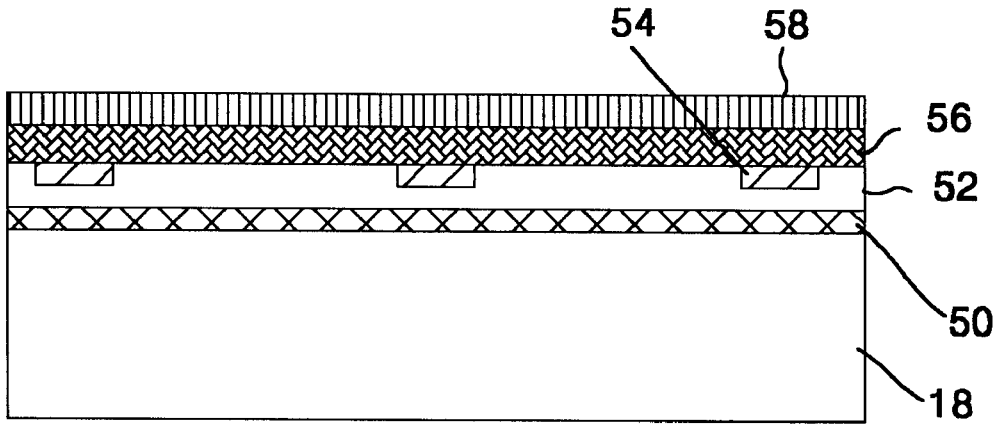
FIG. 8A and FIG. 8B are sectional views of the lower plate taken along A–A' line and B–B' line in FIG. 7, respectively.
Figure 8B:
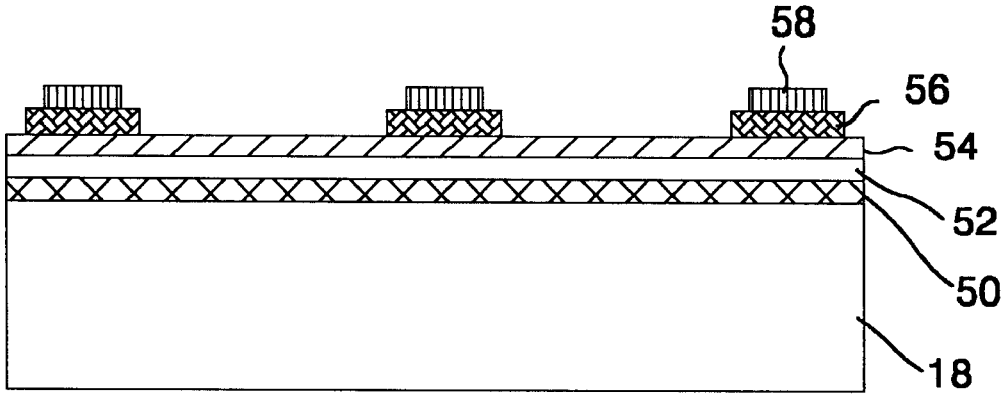

Referring now to FIG. 6, there is shown a PDP discharge cell with a DC-type discharge structure according to another embodiment of the present invention. Further, FIG. 7 is a plan view of the lower substrate of the discharge cell shown in FIG. 6. FIG. 8A and FIG. 8B are sectional views of the lower substrate taken along A–A' line and B–B' line in FIG. 7, respectively. In FIG. 6 to FIG. 8B, the discharge cell includes an upper plate having a first radio frequency electrode 48 provided on an upper substrate 10, a lower plate having a second radio frequency electrode 50, a dielectric layer 52, a scanning electrode 54, an insulating pattern 56 and an address electrode 58 formed sequentially on a lower substrate 18, and a barrier rib 24 coated with a fluorescent material 26. The scanning electrode 54 and the address electrode 58 carry out an address discharge in a DC-type discharge structure to produce priming particles, that is, charged particles as a seed of the radio frequency discharge. An insulating pattern 56 for insulating the scanning electrode 54 and the address electrode 58 is formed in a line shape at the lower portion of the address electrode 58 in such a manner that two electrodes 54 and 58 has a DC-type discharge structure exposed directly to the discharge space. Since the scanning electrode 54 and the address electrode 58 is adjacent to each other with having the insulating pattern 56 therebetween, they cause an address discharge by a lower voltage. A resistor layer(not shown) may be formed under the scanning electrode 54 or the address electrode 58. This resistor layer is used as a current limiting resistor for restraining the overshoot of a discharge current and the sputtering. The first radio frequency electrode 48 consists of a transparent electrode so as not to interfere a luminous light. A radio frequency voltage with a frequency of several MHz to hundreds of MHz is applied to the first radio frequency electrode 48 and a center voltage(i.e., a reference voltage) of the radio frequency voltage is applied to the second radio frequency electrode 50, thereby causing a radio frequency discharge. The dielectric layer 52 is responsible for an insulating layer between the second radio frequency electrode 50 and the scanning electrode 54. The barrier rib 24 formed between the upper substrate 10 and the lower substrate 18 plays a role to provide a discharge space excluding an optical interference from the adjacent discharge cells as well as to support the upper substrate 10 and the lower substrate 18. The fluorescent material 26 is coated on the surface of the barrier rib 24. A discharge gas is injected into the discharge space. The Penning effect is mainly utilized for the general AC or DC discharge. On the other hand, in the radio frequency discharge, positive ions keep almost a stationary state and only electrons excite gas atoms while doing an oscillating motion, so that it is effective to use Xe gas with a relatively low excitation energy level as the discharge gas. In this case, since a discharge voltage is raised if the Xe gas only is used, a mixture gas of He and Ne, etc can be used so as to improve the efficiency. The general AC or DC discharge has a disadvantage in that the color purity becomes poor due to a radiation of an orange color generated at an excitation level of Ne during the Penning action. Otherwise, the radio frequency discharge concentrates an energy level of electrons on the excitation energy of Xe to prevent the radiation of an orange color generated from Ne, so that it can improve the color purity.

Figure 9A:
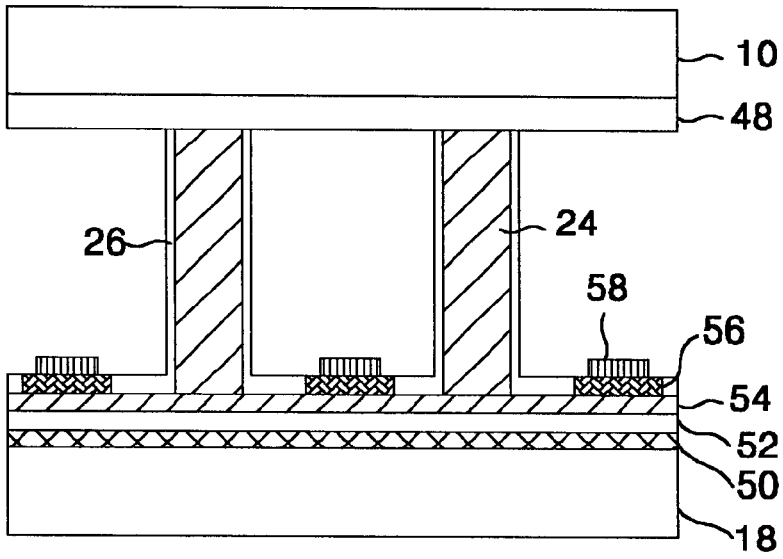
FIGS. 9A to 9D are sectional views showing a driving mechanism in the discharge cell in FIG. 6 step by step.
Figure 9B:
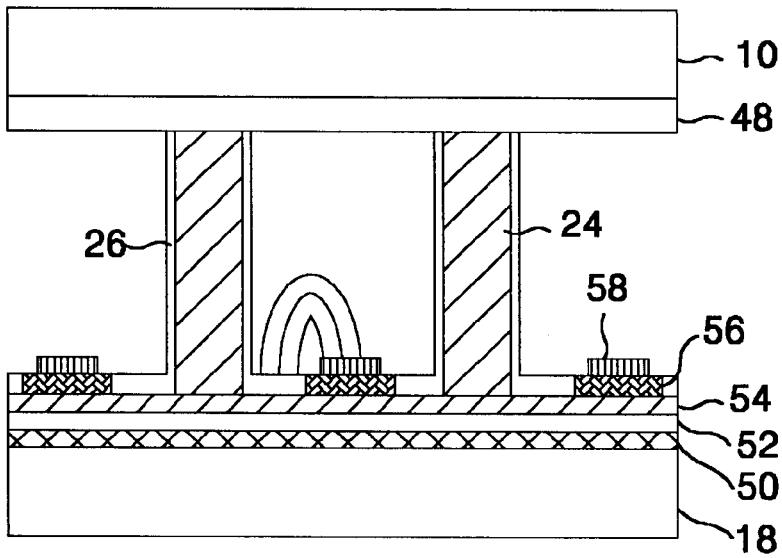
Figure 9C:
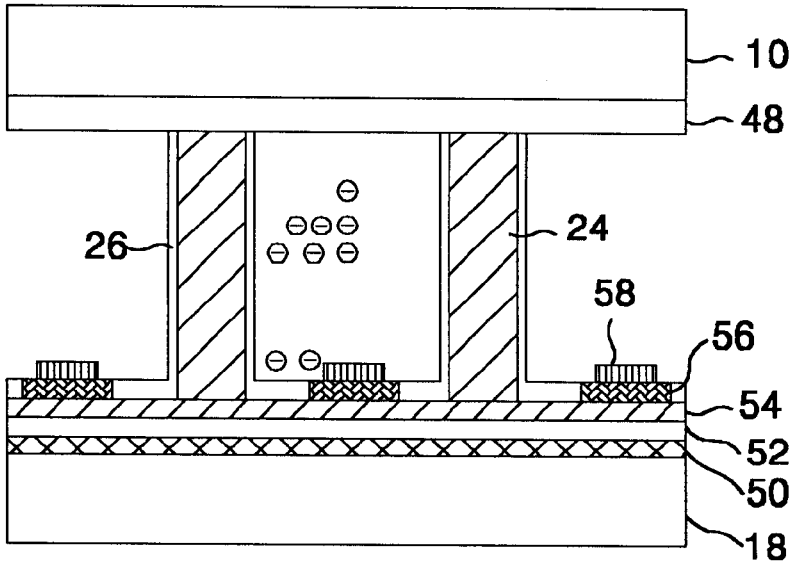
Figure 9D:
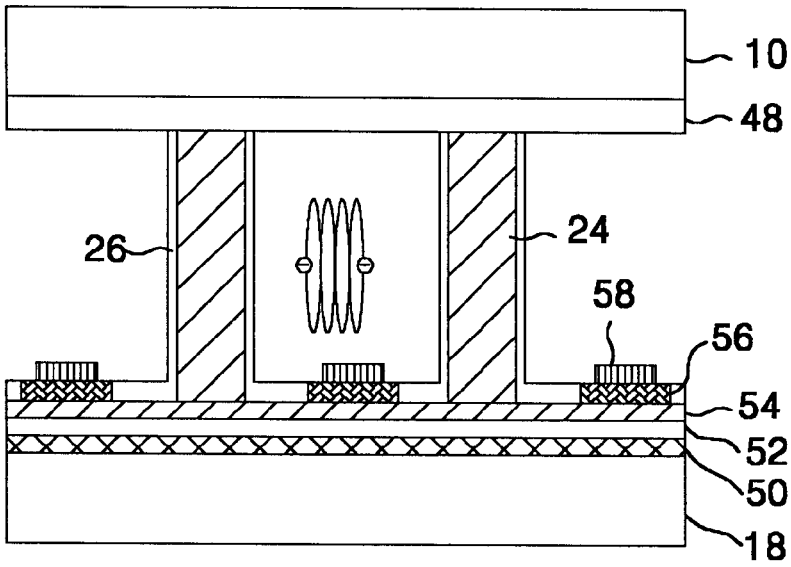

FIGS. 9A to 9C are sectional views representing a driving mechanism of the discharge cell in FIG. 6 step by step. Referring to FIGS. 9A and 9B, a scanning pulse and a data pulse is simultaneously applied to each of the scanning electrode 54 and the address electrode 58 to generate an address discharge of DC type at the discharge cell. By this address discharge, charged particles are produced at the discharge space as shown FIG. 9C. These charged particles, that is, electrons and positive ions form a current path between the first and the second radio frequency electrodes 48 and 50. A discharge current flows via the current path when the scanning pulse and the data pulse is being applied. In other words, electrons as a seed of the radio frequency sustaining discharge are produced within the discharge space by the address discharge. Then, a radio frequency pulse is applied to the first radio frequency electrode 48 and a reference voltage of a radio frequency pulse is applied to the second radio frequency electrode 50, thereby generating an oscillating electric field at the discharge space. By this oscillating electric filed, the electrons ionize and excite discharge gases continuously while doing an oscillation motion within the discharge space as shown in FIG. 9D to thereby emit more lots of vacuum ultraviolet rays. As a result, a luminous amount of the fluorescent body is increased the vacuum ultraviolet rays. Meanwhile, since electrons as a seed of the radio frequency discharge are not produced within the discharge space, a radio frequency discharge fails to be generated in a discharge cell in which an address discharge does not occur. The radio frequency discharge can be stopped by applying a desired level of DC erasing voltage to any one of the scanning electrode 54, the address electrode 58, and the first and second radio frequency electrodes 40 and 50. In this case, electrons are vanished toward an electrode to which an erasing pulse is applied, thereby terminating the radio frequency discharge.

Figure 10:
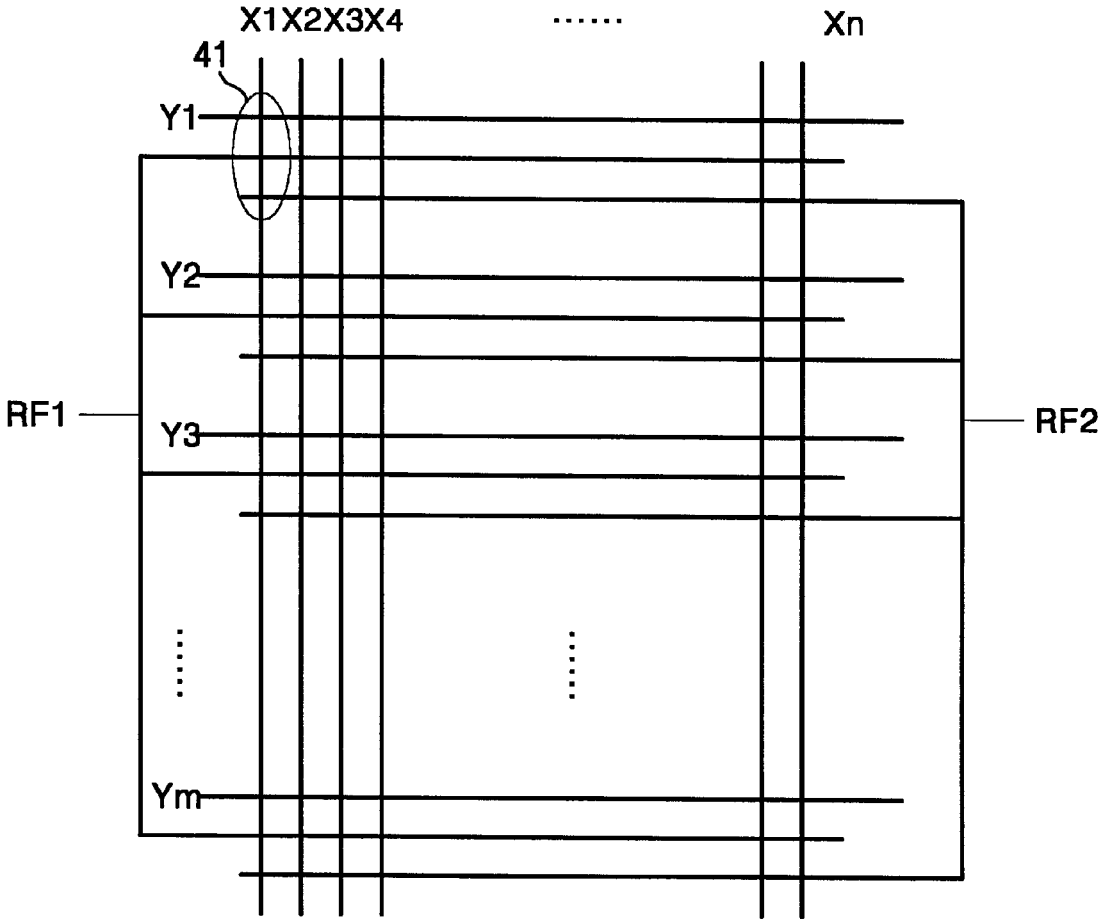
FIG. 10 is a schematic view representing an electrode arrangement in a PDP having the discharge cell shown in FIG. 6 in a matrix pattern.
Figure 11:
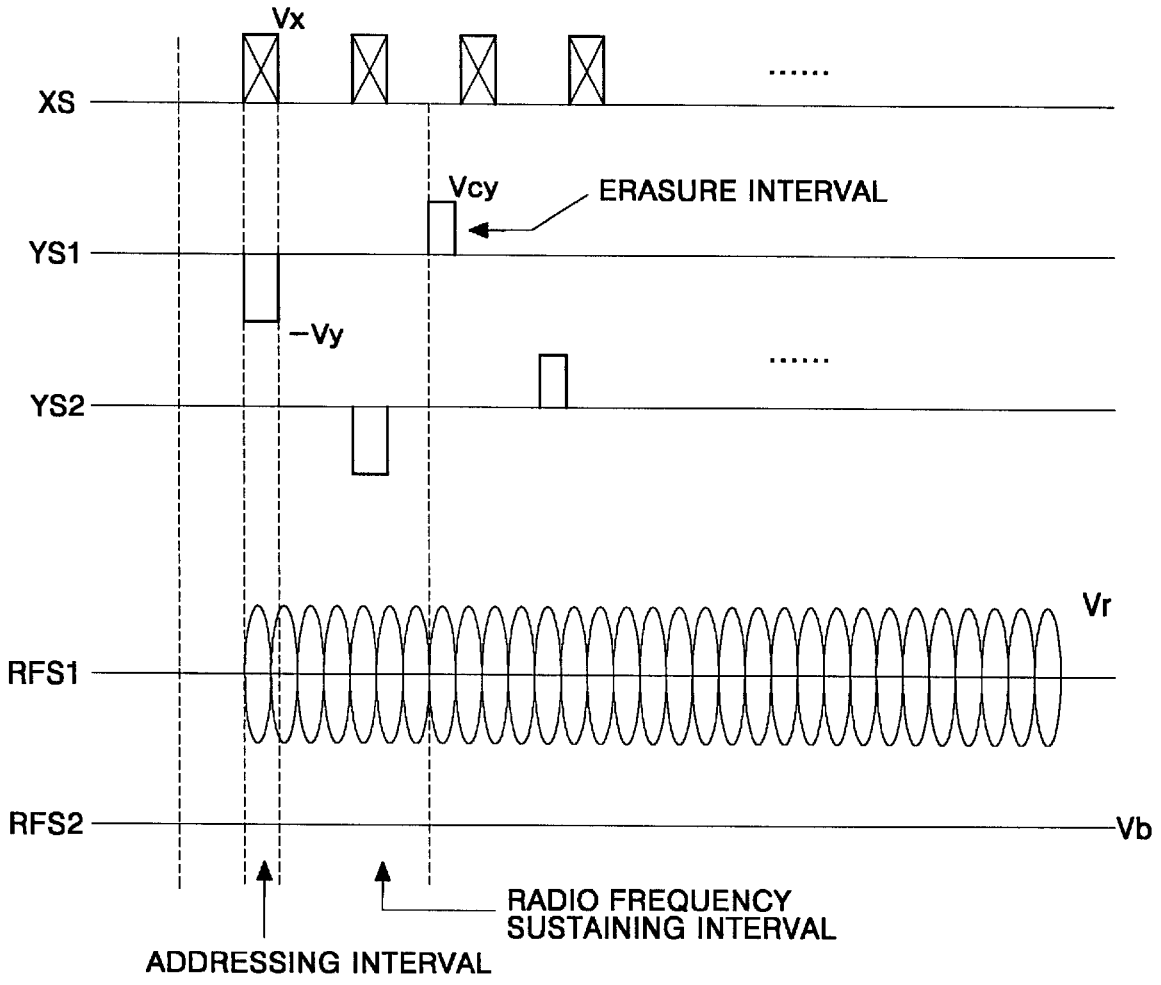
FIG. 11 is waveform diagrams of driving voltages applied to electrode lines shown in FIG. 10.

FIG. 10 shows an electrode arrangement of a PDP having the discharge cell in FIG. 6 arranged in a matrix pattern. In FIG. 10, the PDP includes n address electrode lines X1 to Xn, m scanning electrodes Y1 to Ym crossed and arranged alternately with the address electrode lines X1 to Xn, and first and second radio frequency electrodes RF1 and RF2. Discharge cell are provided at intersections among the address electrode lines X1 to Xn, scanning electrodes Y1 to Ym and the first and second radio frequency electrode lines RF1 and RF2. A scanning pulse is line-sequentially applied to the scanning electrode lines Y1 to Ym, and a data pulse synchronized with the scanning pulse is applied to the, address electrode lines X1 to Xn in a horizontal line unit. A radio frequency voltage is commonly applied to the first radio frequency electrode line RF1 while a reference voltage of the radio frequency voltage is commonly applied to the second radio frequency electrodes RF2. Herein, the first radio frequency electrode line RF1 and/or the second radio frequency electrode line RF2 is fabricated in a shape of electrode plate so as to improve the discharge uniformity. FIG. 11 represents waveform diagrams of drive signals for driving the PDP shown in FIG. 10. In FIG. 11, XS represents a drive waveform applied to the address electrode lines X1 to Xn; YS1 and TS2 do drive waveforms applied to the first and second scanning electrode lines Y1 and Y2, respectively; and RFS1 and RFS2 do drive waveforms applied to the first and second radio frequency electrode lines RF1 and RF2, respectively. A scanning pulse −Vy is sequentially applied to the scanning electrode lines Y1 to Ym, and a data pulse Vx corresponding to one bit of each pixel data is applied to the address electrode lines X1 to Xn in a horizontal line unit with being synchronized with the scanning pulse. Accordingly, an address discharge of DC type is sequentially generated in a horizontal line unit in accordance with a logical value of the data pulse. At this time, a radio frequency voltage Vr is applied to the first radio frequency electrode lines RF1 while a reference voltage, that is, a direct current bias voltage Vb is applied to the second radio frequency electrode line RF2. By this radio frequency voltage, a radio frequency discharge is continuously generated at discharge cells producing charged particles by the address discharge to display a desired brightness. In this case, since the radio frequency discharge is generated continuously with the address discharge generated in a line sequence, it is line-sequentially initiated and sustained. Further, electrons having done an oscillation motion in the discharge space is attracted and vanished into the scanning electrode lines Y1 to Ym by an erasing voltage pulse Vcy applied to the scanning electrode lines Y1 to Ym sequentially, thereby stopping the radio frequency discharge. Accordingly, the brightness can be controlled by adjusting an application time of the erasing voltage pulse Vcy.

Figure 12:
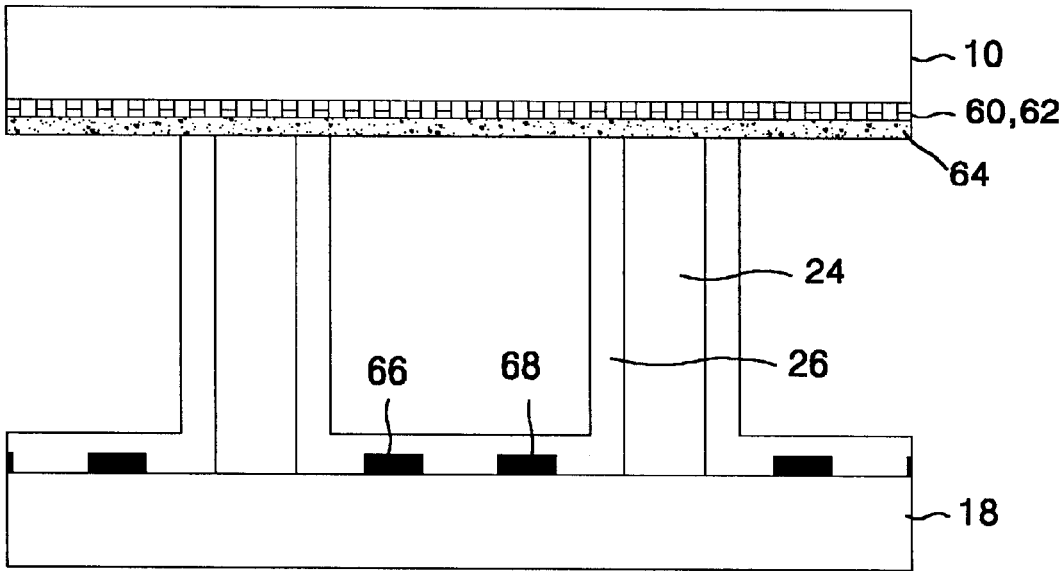
FIG. 12 is a sectional view showing the structure of a discharge cell in a PDP according to still another embodiment of the present invention.
Figure 13A:
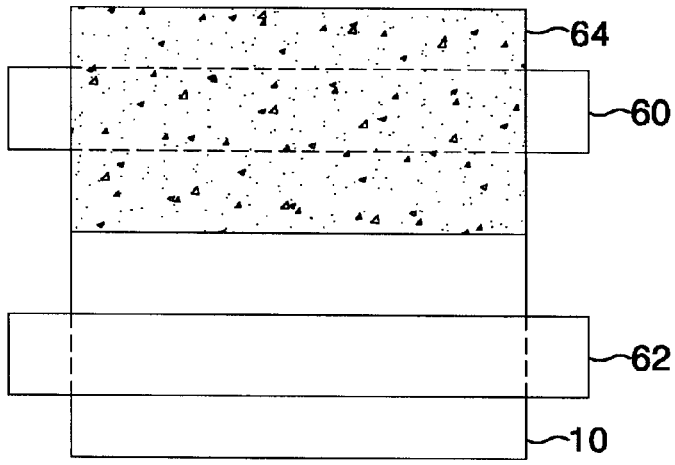
FIG. 13A and FIG. 13B are sectional views of the lower plate taken along A–A' line and B–B' line in FIG. 12, respectively.
Figure 13B:
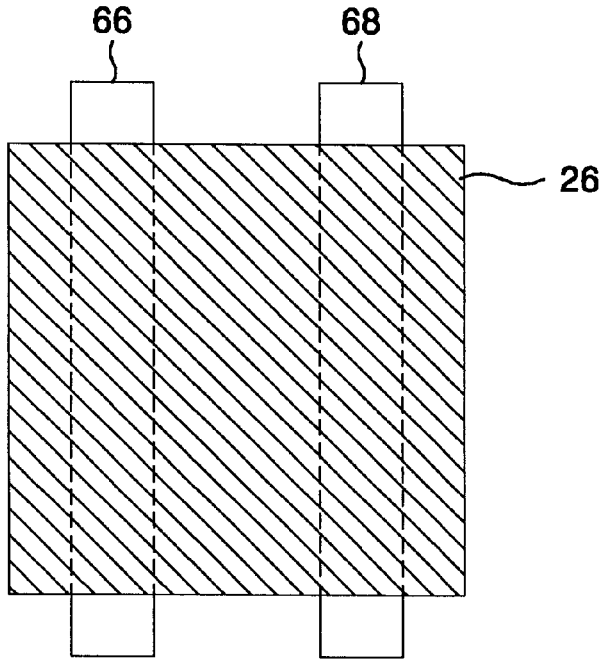

Referring now to FIG. 12, there is shown a discharge cell of a PDP according to still another embodiment of the present invention. FIG. 13A and FIG. 13B are plan views showing the structure of the upper plate and the lower plate of the discharge cell in FIG. 12, respectively. The discharge cell includes a first radio frequency electrode 60 and a scanning electrode 62 arranged, in parallel, on an upper substrate 10, a second radio frequency electrode 66 and an address electrode 68 arranged, in parallel, on a lower substrate 18, and a barrier rib 24 coated with a fluorescent material 26. The first radio frequency electrode 60 and the scanning electrode 62 are arranged, in parallel, on the upper substrate 10 in the horizontal direction, whereas the second radio frequency electrode 66 and the address electrode 68 are arranged, in parallel, on the lower substrate 18 in the vertical direction. The first and second radio frequency electrodes 60 and 66 initiate and sustain a radio frequency discharge. The scanning electrode 62 and the address electrode 68 stop the radio frequency discharge in accordance with a logical value of the data pulse. The scanning electrode 62 and the address electrode 68 has a DC-type discharge structure. In light of a principle of the radio frequency discharge, positive ions sustain almost a stationary state because they have a relatively heavy mass compared with electrons and, therefore, fail to move instantly in accordance with a change in a radio frequency field. Accordingly, a protective layer is not need on the upper plate because an ion impact to the electrodes does not exist during the radio frequency discharge, but a protective layer 36 may be formed only on the first radio frequency electrode 60 as shown in FIG. 13A so as to improve a generation efficiency of secondary electrons. The fluorescent material 26 is coated on the surface of the barrier rib 24 and the lower substrate 18 provided with the second radio frequency electrode 66 and the address electrode 26. In such a discharge cell, any one of the upper substrate 10 and the lower substrate 18 can be used as a picture display surface. In this case, electrodes arranged at the substrate used as the picture display surface are formed of transparent electrodes capable of transmitting a light.

Figure 14A:
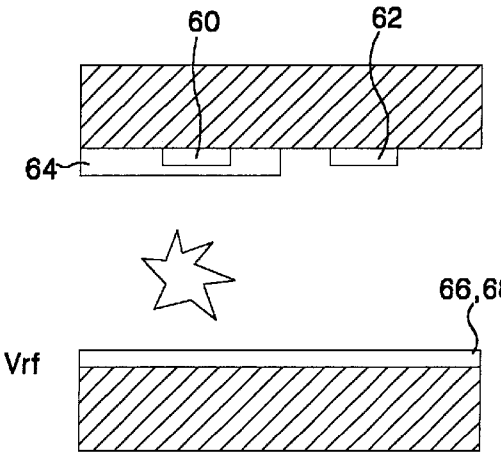
FIGS. 14A to 14C are sectional views showing a driving mechanism in the discharge cell in FIG. 12 step by step.
Figure 14B:
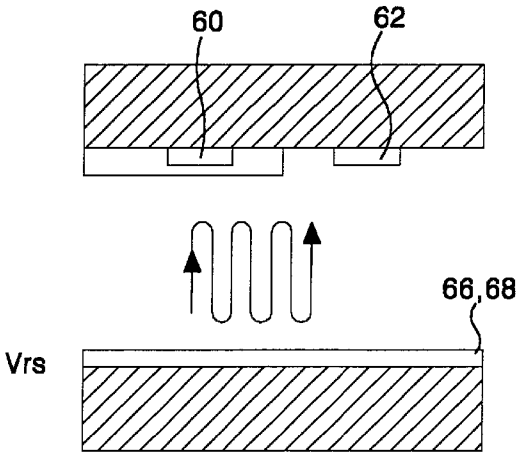
Figure 14C:
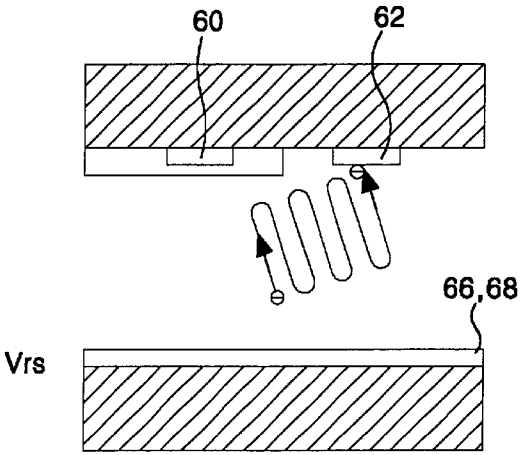

FIGS. 14A and 14C are sectional views showing a driving mechanism of the discharge cell in FIG. 12 step by step. A radio frequency voltage able to initiate the discharge is applied to the second radio frequency electrode 66 and a bias voltage, that is, a center voltage of a radio frequency voltage is applied to the first radio frequency electrode 60, thereby initiating a radio frequency discharge at the discharge cell as shown in FIG. 14A. Then, a voltage value of the radio frequency voltage applied to the second radio frequency electrode 66 is lowered into such a voltage value that can sustain the discharge while the bias voltage applied to the first radio frequency electrode 60 being sustained as it was. Accordingly, in the discharge cell, electrons ionize and excite discharge gases while doing an oscillation motion within the discharge space as shown in FIG. 14B to emit a vacuum ultraviolet ray, thereby radiating the fluorescent body 26. Subsequently, by applying a positive DC voltage to the scanning electrode 62 and, at the same time, applying a negative DC voltage to the address electrode 68, electrons are attracted into the scanning electrode 62 applied with the positive voltage with reducing their oscillation width to vanish charged particles, thereby stopping the discharge.

Figure 15:
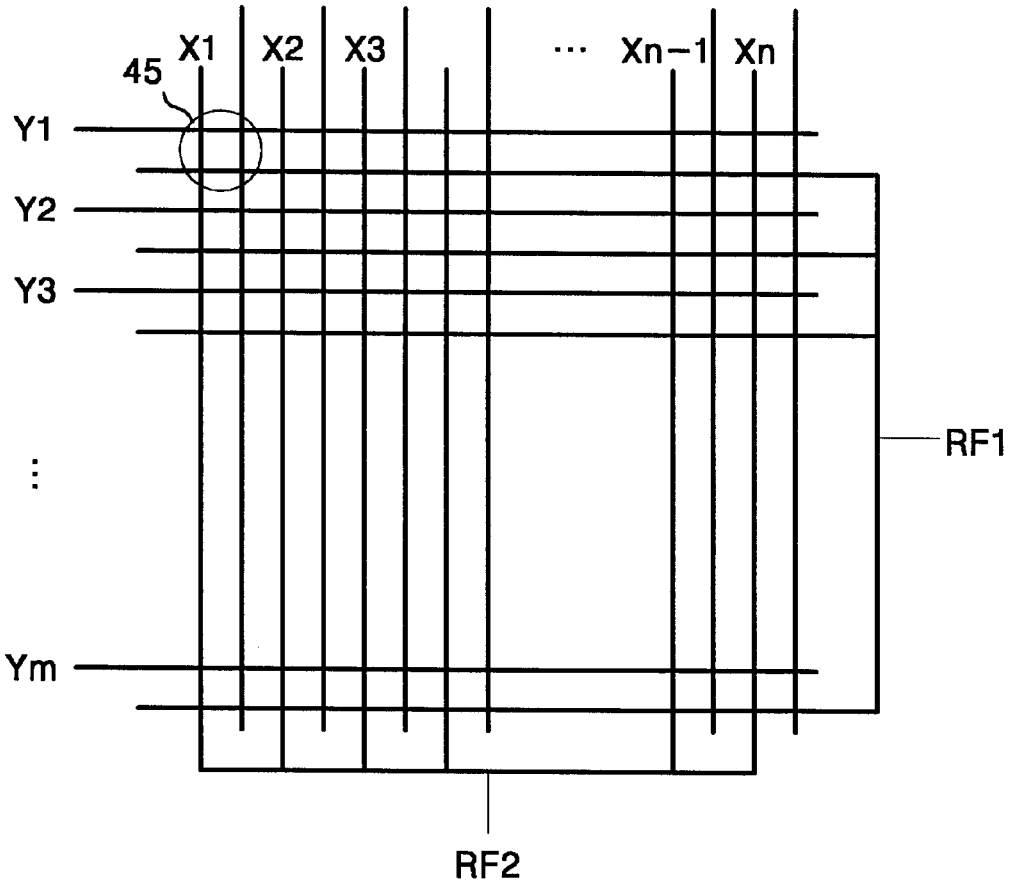
FIG. 15 is a schematic view representing an electrode arrangement in a PDP having the discharge cell shown in FIG. 12 in a matrix pattern.

FIG. 15 shows an electrode arrangement of a PDP having the discharge cell in FIG. 12 arranged in a matrix pattern. In FIG. 15, the PDP includes first radio frequency electrode lines RF1 and scanning electrode lines Y1 to Ym arranged alternately, and second radio frequency electrode lines RF2 and address electrode lines X1 to Xn crossing with the first radio frequency electrode lines RF1 and the scanning electrode lines Y1 to Ym. A discharge cell 45 is provided at each intersection between the first radio frequency electrode lines RF1 and the scanning electrode lines Y1 to Ym and between the second radio frequency electrode lines RF2 and the address electrode lines X1 to Xn. The first and second radio frequency electrode lines RF1 and RF2 are used to initiate and sustain a radio frequency discharge. The address electrode lines X1 to Xn and the scanning electrode lines Y1 to Ym are used to erase the discharge selectively in accordance with a data while scanning the screen. In this case, the address electrode lines X1 to Xn and the scanning electrode lines Y1 to Ym are driven individually, whereas the first and second radio frequency electrode lines RF1 and RF2 are driven commonly.

Figure 16:
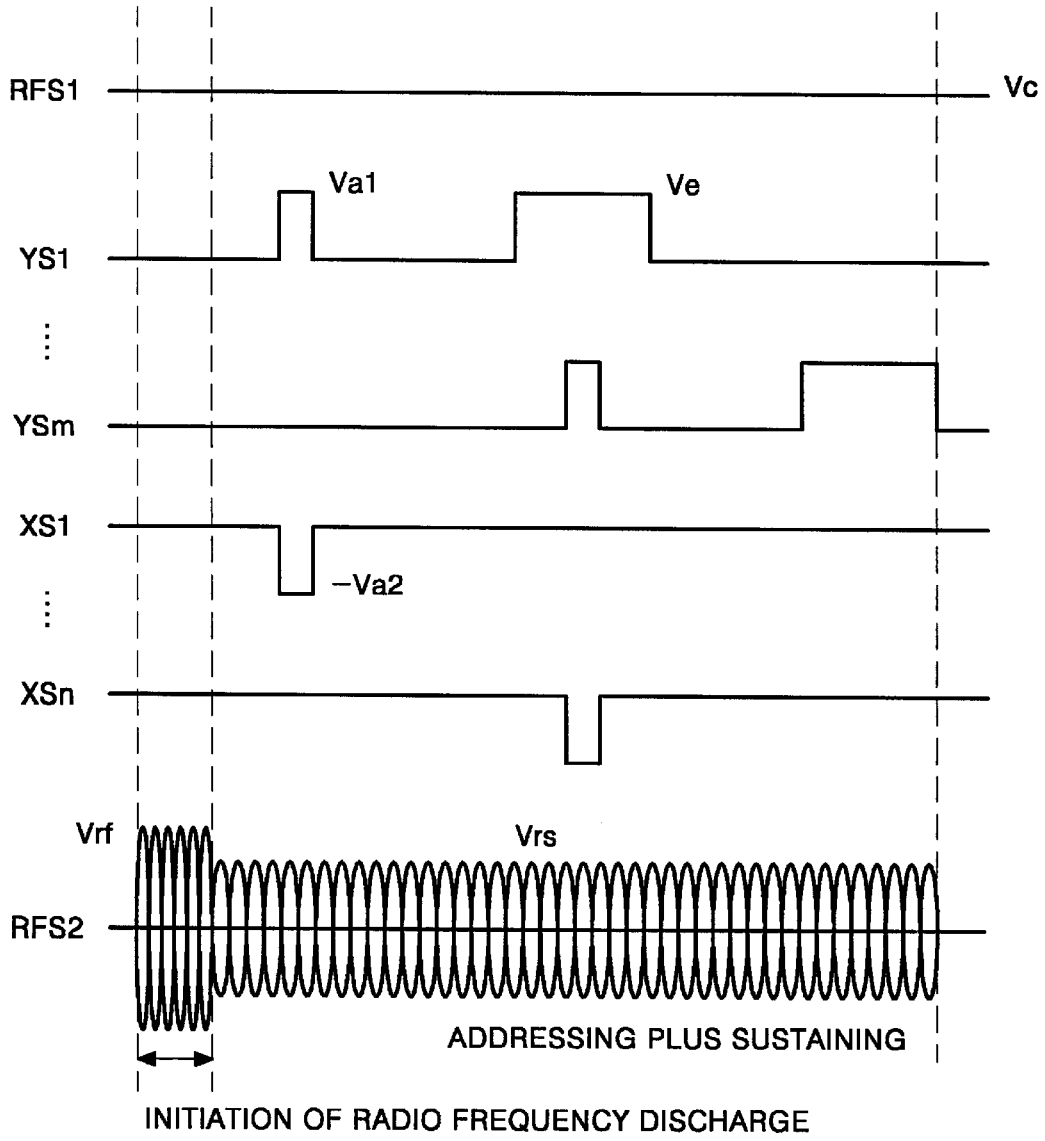
FIG. 16 is waveform diagrams of driving voltages applied to electrode lines shown in FIG. 15.

FIG. 16 represents waveform diagrams of drive signals for driving the PDP shown in FIG. 15. The driving waveforms in FIG. 15 are applied to a selective erasing method that erasing the discharge in discharge cells without any display data in a row line unit while initiating a radio frequency discharge at all the discharge cells simultaneously and then sustaining the radio frequency discharge. First, a radio frequency voltage Vrf with a voltage for the discharge initiation is applied to the second radio frequency electrode lines RF2 and a center voltage Vc of the radio frequency voltage is applied to the first radio frequency electrode lines RF1, thereby initiating a radio frequency discharge at all the discharge cells. Next, a voltage value of the radio frequency voltage applied to the second radio frequency electrode lines RF2 is lowered into a discharge sustaining voltage value Vrs to sustain the radio frequency discharge. Then, a scanning pulse (i.e., an erasing pulse) with a positive voltage value Va1 is line-sequentially applied to the scanning electrode lines Y1 to Ym. At the same time, a data pulse with a negative voltage value −Va2 is synchronized with the scanning pulse (or the erasing pulse) and applied to the address electrode lines X1 to Xn in a line unit in correspondence with a low logical value (i.e., '0') of video data. Accordingly, the radio frequency discharge is erased at the discharge cells to which a low logical value of data pulse is applied, whereas the discharge is sustained at the discharge cells to which a low logical value of data pulse is not applied by the radio frequency voltage applied between the first and second radio frequency electrodes RF1 and RF2. At this time, a voltage value Va1 of the scanning pulse (or the erasing pulse) applied to the scanning electrode lines Y1 to Ym is properly enlarged compared with a voltage value Va2 of the data pulse applied to the address electrode lines X1 to Xn, thereby minimizing an interference upon addressing of other lines. If a desired discharge sustaining interval for displaying a certain brightness lapses, then an erasing voltage(Ve) pulse with a relatively large width is line-sequentially applied to the scanning electrode liens Y1 to Yn to stop the radio frequency discharge having been sustained in a desired time interval. In this case, the brightness control is permitted by adjusting an application time of the erasing voltage(Ve) pulse in accordance with a gray level of the display cell.

As described above, in the PDP according to the present invention, an address discharge of DC type and a radio frequency discharge is allowed, so that the brightness and the discharge efficiency can be maximized. Also, according to the present invention, charged particles formed by the DC priming discharge is used for the sustaining discharge to allow an easy radio frequency discharge, so that a low power consumption is permitted.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel having a plurality of discharge cells arranged in a matrix pattern, first and second substrates arranged oppositely, and a discharge space divided by a barrier rib provided between the first and second substrates, said plasma display panel comprising;

a direct current discharging electrode part for applying a direct current to cause a writing discharge within the discharge cells, said electrode part having electrodes crossed with each other; and a radio frequency discharging electrode part for applying a radio frequency voltage to generate a sustaining discharge caused by a radio frequency discharge within the discharge cells.

2. The plasma display panel according to claim 1, wherein said direct current discharging electrode part includes an address electrode and a scanning electrode crossed with each other at each of the first and second substrates, and an auxiliary anode provided within a separate auxiliary space formed within the discharge space; and wherein said radio frequency discharging electrode part includes first and second radio frequency electrodes formed in oppostion to the barrier rib.

3. The plasma display panel according to claim 1, wherein said direct current discharging electrode part includes a scanning electrode and an address electrode crossed with each other at the first and second substrates respectively; and wherein said radio frequency discharging electrode part includes first and second radio frequency electrodes provided between the first and second substrates.

4. The plasma display panel according to claim 3, further comprising:

a resistor layer adjacent at least one of the scanning electrode and the address electrode to limit an over current.

5. The plasma display panel according to claim 1, wherein said direct current discharging electrode part includes an address electrode, an insulating layer and a scanning electrode crossed with each other on the first substrate; and wherein said radio frequency discharging electrode part includes first and second radio frequency electrodes provided at each of the first and second substrates to apply a radio frequency voltage and a reference voltage, respectively.

6. The plasma display panel according to claim 5, wherein said insulating layer is patterned in a strip shape along the address electrode.

7. The plasma display panel according to claim 5, further comprising:

a resistor layer provided at the lower portion of any one of the scanning electrode and the address electrode to limit an over current.

8. A plasma display panel, comprising:

first substrate;

a second substrate;

first and second barrier ribs spaced in opposing relation between the first and second substrates;

a first radio frequency electrode included on the first barrier rib; and a second radio frequency electrode included on the second barrier rib.

9. The plasma display panel of claim 8, wherein the first radio frequency electrode and the second radio frequency electrode are aligned diagonally across a discharge space located between the first and second barrier ribs.

10. The plasma display panel of claim 8, further comprising:

an electrode part which applies a direct current to cause a writing discharge to occur within a discharge space located between the first and second barrier ribs.

11. The plasma display panel of claim 10, wherein the electrode part includes:

a scanning electrode adjacent the first substrate; and an address electrode adjacent the second substrate and disposed in crossed alignment relative to the scanning electrode.

12. The plasma display panel of claim 11, further comprising:

a driving unit for inputting a radio frequency signal into the first radio frequency electrode, said radio frequency signal having a frequency and voltage which causes an oscillation width of electrons moving in the discharge space to be smaller than a width of the discharge space.

13. The plasma display panel of claim 12, wherein the electrons move in a zig-zag pattern between the first and second radio frequency electrodes.

14. The plasma display panel of claim 8, wherein the first and second radio frequency electrodes cause an electron path to form within a discharge space between the first and second barrier ribs, said electron path having a length which is longer than a vertical dimension of said discharge space.

* * * * *